US005575942A

United States Patent [19]

Watanabe

[11] Patent Number: 5,575,942

[45] Date of Patent: Nov. 19, 1996

[54] HEATING ROLLER FOR FIXATION

[75] Inventor: Mitsuyoshi Watanabe, Inazawa, Japan

[73] Assignee: Brother Kogyo Kabushiki Kaisha, Nagoya, Japan

[21] Appl. No.: 524,568

[22] Filed: Sep. 7, 1995

[30] Foreign Application Priority Data

Nov. 16, 1994 [JP] Japan ..... 6-308313
May 10, 1995 [JP] Japan ..... 7-111887

[51] Int. Cl.[6] ..... H05B 3/16

[52] U.S. Cl. ..... 219/469; 219/216; 219/543

[58] Field of Search ..... 219/216, 244, 219/469, 470, 539, 543; 355/285, 289, 290

[56] References Cited

U.S. PATENT DOCUMENTS

| | | | |
|---|---|---|---|
| 3,471,683 | 10/1969 | Bogue | 219/469 |
| 3,624,353 | 11/1971 | Bjorklund | 219/470 |
| 4,659,206 | 4/1987 | Kai et al. | 219/469 |
| 4,724,303 | 2/1988 | Martin et al. | 219/216 |
| 4,743,940 | 5/1988 | Nagasaka et al. | 355/289 |
| 4,745,431 | 5/1988 | Kogure et al. | 355/290 |
| 4,801,968 | 1/1989 | Kogure et al. | 219/216 |
| 4,883,941 | 11/1989 | Martin et al. | 219/216 |
| 5,391,861 | 2/1995 | Ooyama et al. | 219/216 |

FOREIGN PATENT DOCUMENTS

| | | | |
|---|---|---|---|
| 57-101868 | 6/1982 | Japan | 219/469 |
| 62-279378 | 12/1987 | Japan . | |

*Primary Examiner*—Teresa J. Walberg
*Assistant Examiner*—Gregory L. Mills
*Attorney, Agent, or Firm*—Oliff & Berridge

[57] ABSTRACT

A heating roller for fixation has a hollow body with a wall thickness of 1–3 mm. A deposit prevention layer is formed on the outer surface of the roller body. The roller body has excellent heat conductivity. A resistance heat generating member is bonded on and anchored to the inner surface of the roller body. The resistance heat generating member is a flexible heat generating sheet which is formed by adhering a resistance heat generating body composed of predetermined patterns of resistance members, formed of stainless steel or copper foil, on the surface of an insulating film material, made of a polyimide resin, that has heat resistance and insulating characteristics.

17 Claims, 4 Drawing Sheets

HEATING ROLLER FOR FIXATION

BACKGROUND OF THE INVENTION

1. Field of the Invention

The invention relates to a heating roller for fixation in a fixation device used in image formation devices such as copiers, printers, and facsimile devices, and relates especially to a heating roller for fixation in which a resistance heating member is formed in a sheet shape and is anchored inside the roller.

2. Description of the Related Art

Conventionally, with an image formation device using the fixation type of electronic photographing technology, for example, a laser printer, a heat roller in which a halogen lamp is used as the heat source is widely adopted as the fixation device. A fixation device which uses this type of heat roller (FIG. 6) is provided with a heating roller for fixation 104 with a built-in halogen lamp 102 as the heat source. A pressure roller 106 opposes the heating roller for fixation 104. The heating roller for fixation 104 absorbs the radiation heat generated by the halogen lamp 102, causing the heat of the heating roller for fixation 104 to rise to the fixation optimum temperature. The toner image 108 is fixed on a recording medium 110 by the heating of the recording medium 110, which carries the toner image 108, as the recording medium 110 is transported between the heating roller for fixation 104 and the pressure roller 106 by their rotation (arrows).

A temperature sensor 112 is installed so as to contact the heating roller for fixation 104. The electric power applied to the halogen lamp 102 is feedback-controlled based upon the detected temperature of the heating roller for fixation 104. Moreover, a peeling layer 114, composed of fluoride resin or the like, is formed on the surface of the heating roller for fixation 104 to prevent the toner and the recording medium 110 from becoming attached to and wrapping around the heating roller for fixation 104.

With this type of fixation system, the halogen lamp is installed in the center of the hollow heating roller for fixation without adhering to the surface of the roller. Hence, heat efficiency is poor, creating the problem that the time interval between the start of supplying electric current to the halogen lamp 102 and the point at which the heating roller for fixation 104 reaches the predetermined temperature suited for fixation of the toner is too long. As a result, different types of heating rollers for fixation have been suggested to shorten this time interval.

For example, Japanese Unexamined Patent Publication Sho 62-279378 discloses a heating roller for fixation in which a resistance heat generating layer, to be used as a heat source, is provided on the inner surface of the heating roller for fixation. In such a fixation device, the heating roller for fixation, with the built-in resistance heat generating layer on its inner surface as the heat source, the pressure roller to press against the heating roller for fixation, and a pair of power supply members which make contact, from the inside, with both sides of the resistance heat generating layer, are provided. The resistance heat generating layer is heated by the electric current supplied by the power supply members, wherein the heating roller for fixation absorbs the heat, causing the temperature to rise to the fixation optimum temperature. At that time, the toner image is fixed on the recording medium by the heating of the recording medium carrying the toner image while the recording medium is transported between the heating roller for fixation and the pressure roller. An insulating layer is provided between the main body of the heating roller for fixation and the resistance heat generating body to insulate the two bodies. Moreover, the power supply members comprise a mechanism which operates symmetrically to the central location of the heating roller for fixation, enabling efficient heating which adjusts to the width of the recording medium. In addition, a peeling layer, composed of a fluoride resin or the like, is formed on the surface of the heating roller for fixation to prevent the toner and the recording medium 110 from attaching to and wrapping around the heat roller for fixation, in a similar fashion as in the previously described device.

However, in a fixation device based on the heat roller method using the above-stated resistance heat generating layer as a heat source, an insulation layer is first formed to insulate the resistance heat generating layer from the inner surface of the heat roller for fixation. Then the resistance heat generating layer is formed on the inner surface of the insulating layer thus formed. Thus, the manufacturing steps to form the resistance heat generating layer in addition to the insulating layer are increased, resulting in the problem that a large amount of time is required for production of the heating roller for fixation. Moreover, such work processes clearly become more complicated as the inner diameter of the roller within the roller body becomes smaller.

Moreover, because the amount of heat radiated from the ends, in the direction of the axis of the heating roller for fixation, is large, the temperature at both ends tends to be lower than the temperature of the central area. Thus, it is necessary to generate more heat at the ends of the heating roller for fixation to make the temperature distribution uniform throughout. In such cases, the formation of the resistance heat generating layer, to make the temperature distribution of the heating roller for fixation uniform, becomes complicated, resulting in the problem that the time required to form the above-stated resistance heat generating layer increases further.

In order to solve the above problems, a method is considered in which the insulation layer and the resistance heat generating layer are formed on the outer surface of the roller body, but because the paper and the toner slide on the outer surface of the heat generating layer, problems occur in which the resistance heat generating layer is cut or it wears out quite quickly.

SUMMARY OF THE INVENTION

It is an objective of the invention to overcome the above problems by providing a heating roller for fixation wherein a heat generating member, that requires a short time interval to reach the fixation temperature and that is capable of establishing temperature distribution easily and flexibly, is installed without much trouble on the inner surface of the heating roller for fixation.

In order to accomplish the above objective, the heating roller for fixation of the invention comprises a roller body with a hollow inside and a resistance heat generating member which generates heat with the application of predetermined driving signals, wherein the recording material attached to the recording medium which is transported while contacting the outer surface of said roller body is heated and fixed by transmitting the heat generated from the resistance heat generating member to the outer surface of the roller body. The resistance heat generating member is comprised of a heat generating sheet made of a heat generating body attached to an insulating film material and the resistance heat generating member is anchored on the inner surface of the roller body.

With the heating roller for fixation of the invention having the structure described above, the resistance heat generating member is composed of a heat generating sheet made of a resistance heat generating body attached onto an insulating film material. The heating roller for fixation is produced by the simple process of inserting the resistance heat generating member, in the form of a heat generating sheet, into the inside of the roller body and anchoring it on the inner surface of the roller body.

Moreover, according to the invention, the heating roller for fixation is produced in a simple manner so that the resistance heating member in the form of the heat generating sheet is inserted while the resistance heat generating body faces the central section of the roller body and is anchored on the inner surface of the roller body.

Moreover, with the heating roller for fixation according to the invention, the resistance heat generating body is made of a resistance member that has one or more patterns. The patterns have areas with different cross sections in the direction of the axis of the roller body such that the heat generation amount is adjusted so that the temperature distribution of the outer surface of the roller body becomes uniform on the basis of an area with a smaller cross section has a larger amount of heat generation, while an area with a larger cross section generates a smaller amount of heat.

Furthermore, with the heating roller for fixation according to the invention, the resistance heat generating body is made of resistance members that have one or more patterns in which uniformity of the temperature distribution on the outer surface of the roller body is accomplished by making the cross sections at the vicinity of both ends of the roller body to have smaller areas so that the heat generation amount is larger in the vicinity of the ends of the roller body.

Moreover, with the heating roller for fixation according to the invention, the resistance heat generating body comprises resistance members with one or more patterns which have areas with different pattern density in the direction of the roller body, wherein the heat generation amount is adjusted so that the temperature distribution of the outer surface of the roller body is made uniform by using the fact that areas with high pattern density have a larger amount of heat generation, while areas with lower pattern density have a smaller amount of heat generation.

Further, with the heating roller for fixation according to the invention, the resistance heat generating body comprises resistance members with one or more patterns which have areas with high pattern density in the vicinity of the ends of the roller and the heat generation amount is adjusted so that the temperature distribution of the outer surface of the roller body is made uniform by making the heat generation amount large in the vicinity of the ends of the roller body.

In addition, with the heating roller for fixation according to the invention, the roller body contains areas with different thicknesses in the direction of the axis, and the heat generation amount is adjusted so that the temperature distribution of the outer surface of the roller body is made uniform by using the fact that the temperature transmitted to the outer surface of the roller body is higher in areas with smaller thicknesses, while the temperature transmitted to the outer surface of the roller body is lower in areas with larger thicknesses.

Moreover, with the heating roller for fixation according to the invention, the roller body contains areas with small thickness in the vicinity of the ends of the roller and the temperature distribution of the outer surface of the roller body is made uniform by raising the temperature to be transmitted to the outer surface of the roller body in the vicinity of the ends where the amount of heat radiation is large.

Moreover, with the heating roller for fixation according to the invention, the production processes for electrode units and the resistance heat generating body are executed simultaneously by installing electrode units made of the same material as the resistance heat generating body extending from the resistance heat generating body in the inner surface of both ends of the roller body.

In addition, with the heating roller for fixation according to the invention, the formation of said pattern is simplified by forming the resistance heat generating body with a single metal or alloy foil.

As described above, with the heating roller for fixation according to the invention, the resistance heat generating member is composed of a heat generating sheet made of a resistance heat generating body attached onto an insulating film material and the resistance heat generating member, which is a heat generating sheet, is anchored to the inner surface of the roller body. Hence, the heating roller for fixation is easily constructed by inserting a resistance heat generating member, which is a heat generating sheet, into the roller body and by anchoring it to the inner surface of the roller body.

Moreover, with the heating roller for fixation according to the invention, the resistance heat generating member, which is the heat generating sheet, is anchored to the inner surface of the roller body with the resistance heating body facing the central section of the roller body. Thus, the insulation between the roller body and the resistance heat generating body is secured through the insulating film material and a high degree of safety is obtained.

Moreover, with the heating roller for fixation according to the invention, the resistance heat generating body is made of a resistance member that has one or more patterns, and the heat generation amount is adjusted so that the temperature distribution of the outer surface of the roller body becomes uniform, by using the fact that an area with a smaller cross section has a larger amount of heat generation, while an area with a larger cross section has a smaller heat generation amount. Hence, uneven temperature distribution is avoided and an image with an excellent fixation condition is obtained. Moreover, construction of sheet film prior to pattern formation becomes simple by changing only the width of the pattern, keeping the thickness of the pattern as it is.

Furthermore, with the heating roller for fixation according to the invention, the patterns have areas with smaller cross sections in the vicinity of the ends of the roller body, and the heat generation amount is adjusted so that the temperature distribution on the outer surface of the roller body becomes uniform by making the heat generation amount in the vicinity of the ends of the roller body larger, even when the shape of the roller body is cylindrical and the amount of radiation heat in the vicinity of the roller body is large. As a result, uneven temperature distribution is avoided and an image with an excellent fixation condition is obtained.

Moreover, with the heating roller for fixation according to the invention, the patterns have areas with different pattern density in the direction of the axis of the roller body. The heat generation amount is adjusted so that the temperature distribution of the outer surface of the roller body is made uniform by changing the pattern density in the direction of the axis of the roller body by using the fact that areas with high pattern density have larger amounts of heat generation while areas with lower pattern density have smaller heat generation amounts. Thus, uneven temperature distribution is avoided and an image with an excellent fixation condition is obtained. Moreover, construction of sheet film prior to the pattern formation is simplified.

Further, with the heating roller for fixation according to the invention, the patterns have areas with higher density in the vicinity of both ends of the roller body, and the heat generation amount is adjusted so that the temperature distribution of the outer surface of the roller body becomes uniform by making the heat generation amount in the vicinity of both ends of the roller body larger, even when the shape of the roller body is cylindrical and the amount of radiated heat in the vicinity of the roller body is large. Hence, uneven temperature distribution is avoided and an image with an excellent fixation condition is obtained.

In addition, with the heating roller for fixation according to the invention, the roller body contains areas with different thicknesses in the direction of the axis. The heat generation amount is adjusted so that the temperature distribution of the outer surface of the roller body is made uniform by utilizing the fact that the temperature transmitted to the outer surface of the roller body is higher in an area with a smaller thickness, while the temperature transmitted to the outer surface of the roller body is lower in an area with a larger thickness when heat is emitted from the inner surface of the roller. Hence, uneven temperature distribution is again avoided and an image with an excellent fixation condition is obtained.

Moreover, with the heating roller for fixation according to the invention, the roller body contains areas with small thicknesses in the vicinity of the ends of the roller and the temperature distribution of the outer surface of the roller body is made uniform by raising the temperature to be transmitted to the outer surface of the roller body in the vicinity of the ends, even when the shape of the roller body is cylindrical and the amount of radiated heat is large in the vicinity of the ends of the roller body. The uneven temperature distribution is avoided and an image with an excellent fixation condition is obtained as a result.

With the heating roller for fixation according to the invention, the electrode units and the resistance heat generating body are produced as one body without providing a separate ring-shaped electrode by installing electrode units made of the same material as the resistance heat generating body extending from the resistance heat generating body on the inner surface of both ends of the roller body and the electrical contacts between the resistance members and the electrodes are excellent.

In addition, with the heating roller for fixation according to the invention, because the resistance heat generating body is made of a single metal or alloy foil, a resistance heat generating body with light weight and excellent durability is produced easily by etching processes and the like.

BRIEF DESCRIPTION OF THE DRAWINGS

A preferred embodiment according to the invention will be described in detail with reference to the following figures wherein.

DETAILED DESCRIPTION OF PREFERRED EMBODIMENT

Hereafter, an embodiment according to the invention will be explained with reference to the drawings. The present embodiment is an example in which the invention is applied to a heating roller for fixation that is embedded in a fixation device installed in an image formation device, such as a copier, a printer, a facsimile machine, or similar printing device.

Figure 1:
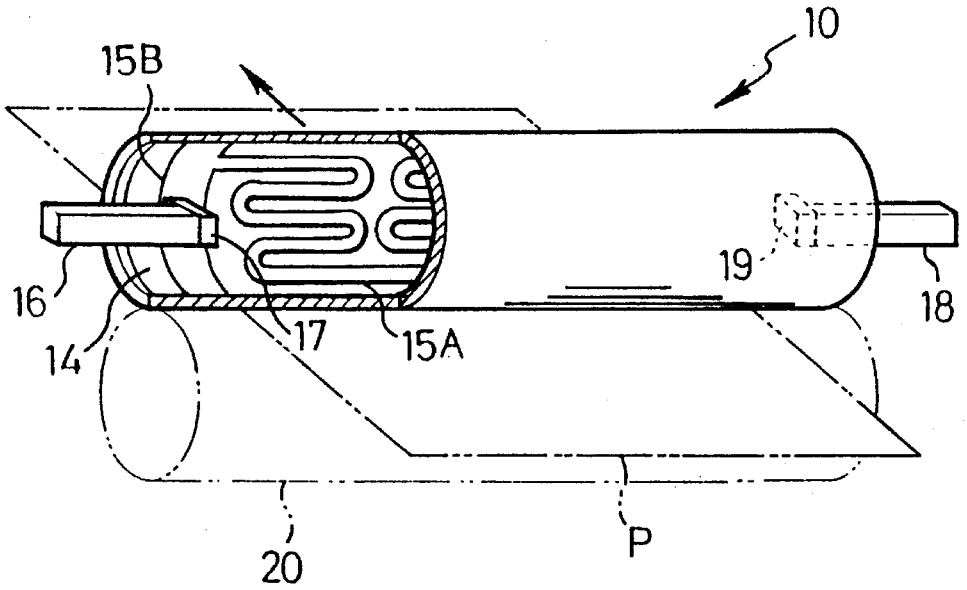
FIG. 1 is an oblique schematic diagram with part of the heating roller for fixation exposed.

As shown in FIG. 1, a heating roller for fixation 10 is pressed against a pressure roller 20 made of rubber. The heating roller for fixation 10 is supported within the printing device body frame to rotate freely by a support mechanism (not shown). The heating roller for fixation 10 fixes the toner deposited on the surface of the recording medium P, which is transported between the pressure roller 20 and the heating roller for fixation 10, by applying heat in addition to the pressure.

The heating roller for fixation 10 has a hollow roller body 11 made of aluminum with about 1–3 mm thickness and has excellent heat conductivity. A deposit prevention layer 12 (FIG. 2) is formed on the outer surface of the roller body 11 and a resistance heat generating member 13 is installed, by bonding, to the inner surface of the roller body 11.

As described, in this embodiment, the material for the roller body 11 is aluminum, but other materials can be used as long as they have excellent heat conductivity, regardless of their electrical conductivity.

The deposit prevention layer 12 has a thickness of about 10–20 μm and is made of a fluoride resin, such as teflon, with excellent heat resistance. The deposit prevention layer 12 prevents the toner on the recording medium P from being deposited on the surface of the heating roller for fixation 10 and being fixed thereto during the fixation process. Hence, dirtying of the recording medium P, caused by toner deposited on the surface of the heating roller for fixation 10 that is further deposited on the front side of the recording medium P or caused by toner that is transferred to the surface of the pressure roller 20 that is further deposited onto the back side of the next transported recording medium P, is prevented.

Figure 2:
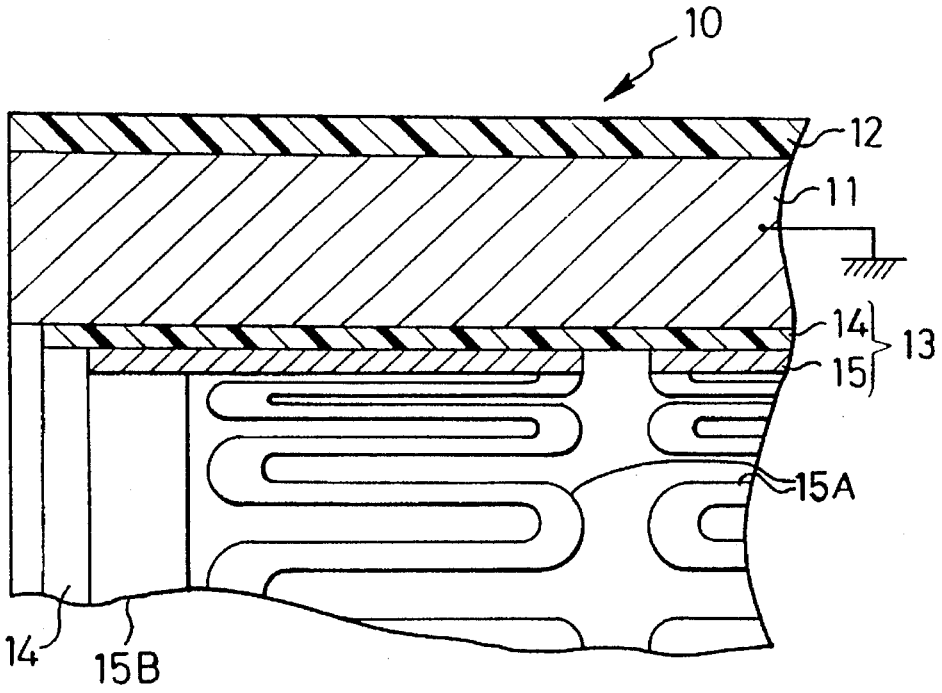
FIG. 2 is a side view of the major vertical cross section part of the heating roller for fixation.
Figure 3:
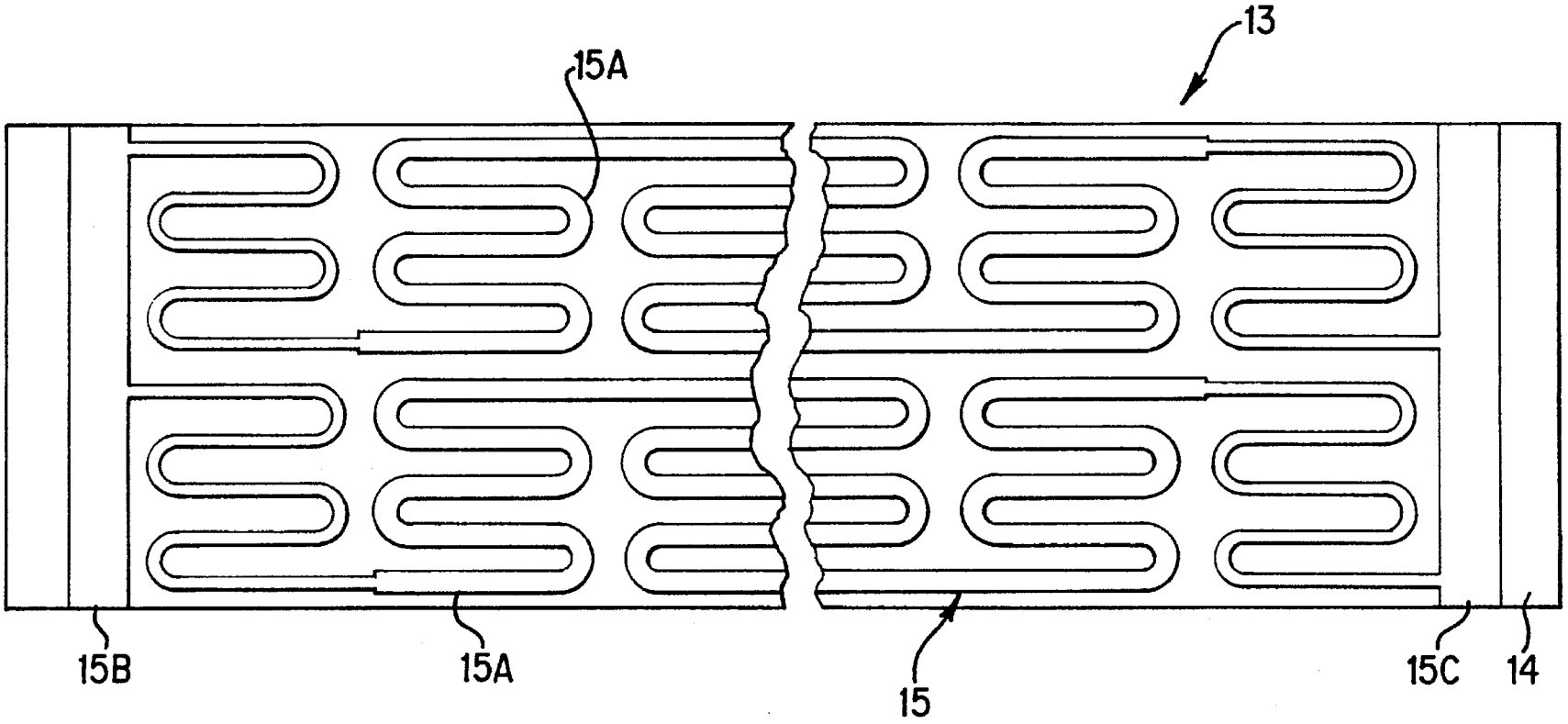
FIG. 3 is an elementary flat view of the resistance heat generating member.

As shown in FIGS. 2 and 3, the resistance heat generating member 13 is a flexible heat generating sheet formed by adhering a resistance heat generating body 15 made by forming resistance member 15A, of one or more elements of stainless steel or copper foil, into a specified pattern on the surface of an insulating film material 14 made of a polyimide resin film with 30–50 μm thickness. The insulating film material 14 has excellent heat resistance and insulation properties. Moreover, on the left and right sides or ends of the resistance heat generating member 13 (as viewed in FIGS. 1–3) are formed the left side electrode unit 15B and the right side electrode unit 15C, respectively, to connect to the corresponding left and right ends of the resistance member 15A to form one continuous body.

In this described embodiment, the resistance member 15A is made of a stainless steel or a copper foil. However, any material of the same type, even a compound foil made of a multiplicity of materials, can be used so long as its heat generation properties are determined and applied as discussed below.

The resistance heat generating member 13 is bonded, and anchored, to the inner surface of the roller body 11 with the resistance heat generating body 15 facing the center section, or interior, of the roller body 11.

Furthermore, as shown in FIG. 1, left and right sliding electrodes 16,18, with brushes 17,19, respectively, at their tip parts, are supported by the body frame (not shown). The left brush 17 makes contact with the left side electrode unit 15B and the right brush 19 makes contact with the right side electrode unit 15C. The resistance member 15A is capable of generating heat over the entire inner surface of the heating roller for fixation 10 when the driving current is supplied through the brushes 17,19.

In the embodiment, as shown in FIG. 3, the widths of the resistance lines of the resistance member 15A at the left and right end parts are thinner than the width of the resistance lines in the central section. Generally speaking, the cross sections of the resistance lines in the left and right end sections are smaller than the cross section of the resistance line in the central section. Hence, the resistance lines of the left and right ends have a larger resistance value, that is to say, the heat generation amount in the left and the right end sections is larger. As such, they prevent a drop in the heating temperature, due to heat release of the heating roller for fixation 10, at the open section of the left and right end parts, and enable heat generation with a uniform temperature distribution over the entire heating roller for fixation 10. As a result, an image with excellent fixation is obtained because an uneven temperature distribution does not exist on the heating roller for fixation 10.

Next, production of the resistance heat generating member 13, which is a heat generating sheet, will be explained briefly.

First, a sheet film is formed by bonding stainless steel or copper foil onto an insulating film material 14 made of a polyimide resin film which has an electrical insulation property. Then a resist, corresponding to the predetermined pattern of resistance member 15A and to the electrodes 15B,15C is painted on the stainless steel or copper foil by screen printing. An etching process is then performed to remove the resist and a heat generating sheet having the resistance member 15A and the electrode units 15B,15C is produced.

Next, a heat resistant bonding material, without bonding power under normal temperatures, is coated on the surface of the insulating film material 14. The surface to which the bonding material is applied is dependent on whether the roller body 11 is electrically conductive. The resistance heat generating member 13 is inserted into the hollow part of the roller body 11 with the resistance heat generating body 15 facing the central section or interior of the roller body 11 if the material of the roller body 11 is electrically conductive, such as aluminum. Then, the roller body 11 and the resistance heat generating member 13 are heated by a high temperature furnace to bond and anchor the resistance generating member 13 onto the inner surface of the roller body 11 while the resistance heat generating member 13 is pressed by air pressure, inflatable device or the like to make contact with the inner surface of the roller body 11.

If the material of the roller body 11 is made of an electrically non-conductive material, the resistance heat generating member 13 can be bonded onto the inner surface of the roller body 11 with the resistance heat generating body 15 facing the central section or interior of the roller body 11, or the resistance heat generating member 13 can be bonded onto the inner surface of the roller body 11 with the insulating film material 14 facing the central section or interior of the roller body 11.

Next, the heating operation of the heating roller for fixation thus structured will be explained.

The driving current supplied to the left and right end sliding electrodes 16,18 is supplied to the left and right end electrode units 15B,15C, through brushes 17,19, and then to the resistance member 15A causing the resistance member 15A to generate heat. In this case, because the cross-section areas of the resistance lines in the vicinity of the left and right end sections of the resistance member 15A are made smaller than the cross section area of the resistance line of the central section, the amount of heat generated in the end sections is larger. This structure prevents a drop in the heating temperature of the heating roller for fixation 10, especially at the left and right end parts, and enables heat generation with a uniform temperature distribution across the entire heating roller for fixation 10. Also, because the resistance member 15A and the electrode units 15B,15C are substantially one body, the electric contact between the resistance member 15A and the electrode units 15B,15C is excellent.

The heat generated by the resistance heat generating body 15 is transmitted to the deposit prevention layer 12 through the insulating film material 14 and the roller body 11. Here, the temperature of the heat generated by the resistance heat generating body 15 is even more uniformly distributed by the roller body 11. Finally, the toner deposited on the recording medium P, which is transported between the heating roller for fixation 10 and the pressure roller 20, is heated and fixed.

When the roller body 11 is made of an electrically conductive material, such as aluminum, it is possible to ground the roller body 11. When grounded, a service person can touch the heating roller for fixation 10 without receiving an electric shock during maintenance work. Moreover, even if the insulation of the insulating film material 14 is broken, the driving current of the resistance heat generating body 15 flows to the ground through the roller body 11; hence an electric shock does not occur and the level of safety is increased.

If the toner is charged with a negative potential, the roller body 11 can be given a potential that has reverse characteristics from the potential of the toner, no more than about 1.0 V in absolute value, instead of grounding the roller body 11. In this case, the occurrence of static electricity on the surface of the heating roller for fixation 10 can be eliminated, preventing static electricity offset.

In this manner, the resistance heat generating member 13 is composed of a heat generating sheet which has a resistance heat generating body 15, which is made as one body with a pair of electrode units 15B,15C, and the resistance heat generating member 13 is bonded and anchored on the inner surface of the roller body 11. Thus, the heating roller for fixation 10 can be made simply by bonding and anchoring the resistance heat generating member 13 on the inner surface of the roller body 11. Moreover, if the roller body 11 is made of a conductive material, insulation between the roller body 11 and the resistance heat generating body 15 is secured through the insulating film material 14, resulting in a high level of safety.

Furthermore, it is easy to design and form patterns in such a manner that a desired, or predetermined, amount of heat is generated at any location on the roller body 11. The pattern design becomes even easier if the resistance member 15A is made of a single metal foil or an alloy foil so that the temperature distribution of the roller body 11 can be adjusted freely, whether at both end sections or at the central section.

In addition, because a pair of electrode units 15B,15C is formed extending from the resistance member 15A, the resistance member 15A and the electrode units 15B,15C can be formed as one body without providing a ring-shaped electrode to supply electric power to the resistance member 15A, and which has excellent electrical contact between the resistance member 15A and both electrode units 15B,15C.

Figure 4:
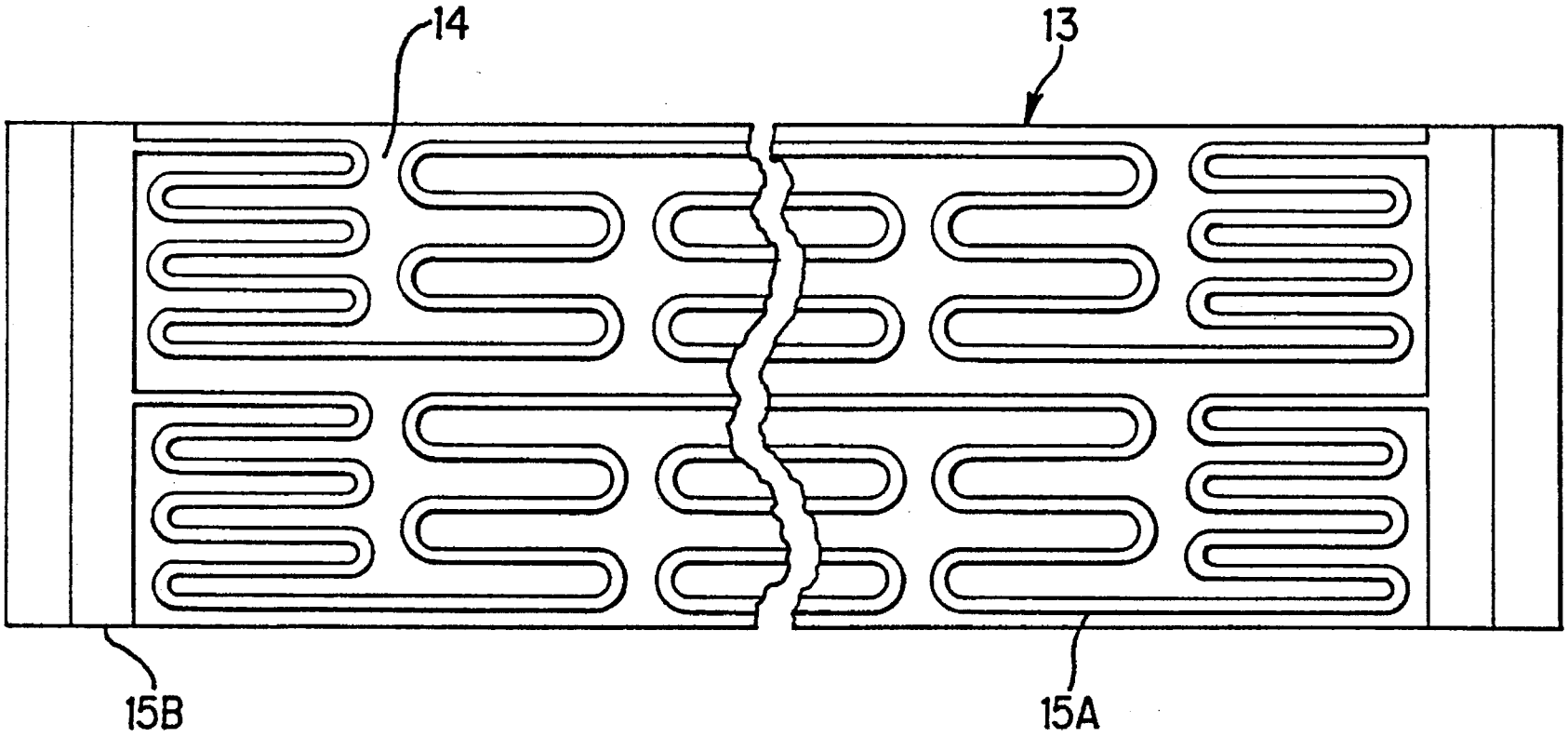
FIG. 4 is an elementary flat view of the resistance heat generating member showing an example of a change in pattern density.
Figure 5:
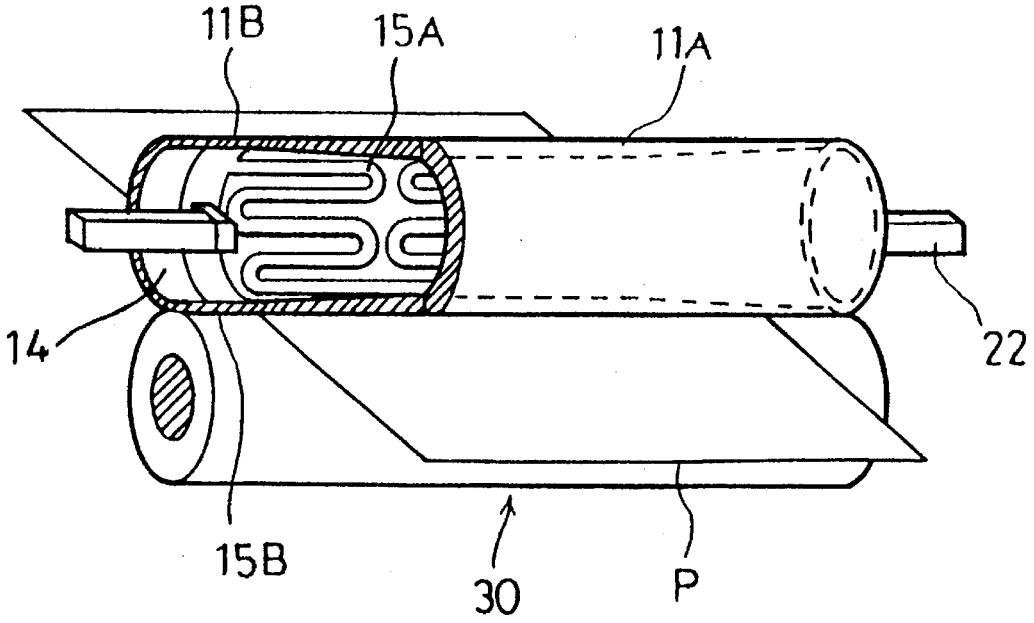
FIG. 5 is an oblique schematic diagram with part of the heating roller for fixation exposed showing an example of a change in thickness of the roller body.
Figure 6:
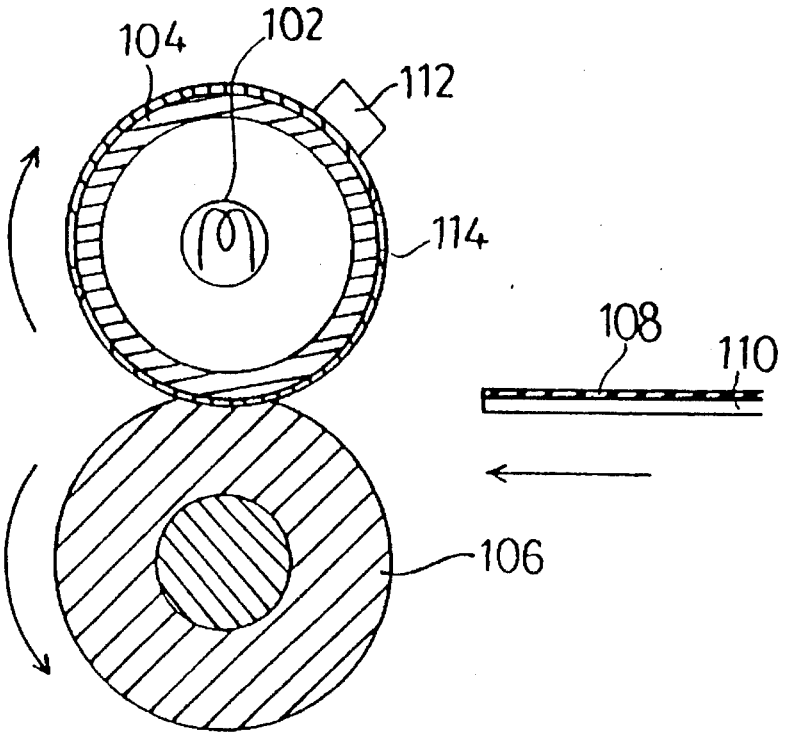
Fig.6 RELATED ART
FIG. 6 is a schematic cross section of a conventional fixation device.

In this embodiment, the cross-section area of the pattern composed of the resistance member 15A in the direction of the axis of the roller body 11 is changed in order to make the temperature distribution uniform on the outer surface of the roller body 11. The uniform temperature distribution can also be obtained by changing the density of the pattern (FIG. 4) in the direction of the axis of the roller body 11 or by varying the thickness of the roller body 11 at each end while maintaining a uniform pattern and line thickness of the resistance member 15A (FIG. 5). Moreover, a change in the pattern cross-section, a change in the pattern density, and a change in the thickness of the roller body 11 can be combined.

Furthermore, in the embodiment it was discussed that changes in the pattern cross section, changes in the pattern density, and changes in the thickness of the roller body would be in the vicinity of the left and right ends of the roller body 11 to increase the amount of heat generated or transferred to the outer surface of the roller body 11. However, these changes can be made at any location on the roller body 11, rather than in the vicinity of the left and the right ends.

Moreover, in the embodiment, the resistance member 15A and the electrode units 15B,15C are formed as one body. However, ring-shaped electrode units can be formed in the inner surfaces of the left and the right ends of the roller body 11, respectively, and the end parts of the resistance member 15A can be connected to the corresponding electrode unit 15B,15C.

Here, it is possible to add various changes to this embodiment based on existing technologies or technologies clear to the inventor within the range of the technological concept according to the invention.

The invention, described in the context of printing devices, can be applied to other heating rollers having a roller body.

What is claimed is:

1. A heating roller for fixation which makes contact with an outer surface of a pressure roller and which heats and fixes a recording material deposited on a recording medium, comprising:

a hollow roller body;

a resistance heat generating member which generates heat with application of a predetermined driving signal, said resistance heat generating member comprising a heat generating sheet which is made by bonding a resistance heat body on an electrically insulating film material, said resistance heat generating member being anchored on an inner surface of said roller body, said resistance heat generating member comprising an electrically resistant material formed as:

a plurality of parallel serpentine patterns, each serpentine pattern having a constant width in a direction along a longitudinal axis of the hollow roller body and constant pitch between legs of the serpentine pattern in a circumferential direction of the hollow roller body, adjacent serpentine patterns joined to one another; and a circumferential band formed proximate each end of the hollow roller body, each circumferential band connected to the adjacent serpentine pattern; and means for generating increased heat at each end of the hollow roller body than at a center of the hollow roller body so the hollow roller body has a substantially uniform temperature distribution along an entire outer surface thereof.

2. The heating roller for fixation as claimed in claim 1, wherein said resistance heat generating member is anchored on the inner surface of said roller body with said resistance heat generating body facing a central section of said roller body.

3. The heating roller for fixation as claimed in claim 1, wherein the means for generating increased heat comprises a serpentine pattern at the center of the hollow roller body having a lower electrical resistance then an electrical resistance of a serpentine pattern at a position adjacent each end of said hollow roller body so that the temperature distribution of the outer surface of said hollow roller body is substantially uniform.

4. The heating roller for fixation as claimed in claim 3, wherein each serpentine pattern of said resistance heat body has a cross section, wherein the cross section of the serpentine patterns adjacent the ends of said hollow roller body have a smaller cross section than the cross section of a center serpentine pattern.

5. The heating roller for fixation as claimed in claim 1, wherein the means for generating increased heat comprises the serpentine patterns of said resistance heat body adjacent the ends of said hollow roller body has a smaller pitch between legs of the serpentine pattern that the pitch between legs of a serpentine path at the center of said hollow roller body so that the temperature distribution of the outer surface of said hollow roller body is substantially uniform.

6. The heating roller for fixation as claimed in claim 1, wherein said means for generating increased heat comprises said hollow roller body having areas with different thicknesses along the longitudinal axis of said roller body so that the temperature distribution of the outer surface of said hollow roller body is substantially.

7. The heating roller for fixation as claimed in claim 6, wherein said hollow roller body has areas with smaller thicknesses at each end of said hollow roller body.

8. The heating roller for fixation as claimed in claim 1, further comprising a deposit prevention layer provided on an outer surface of said hollow roller body, said deposit prevention layer preventing deposit of the recording material onto an outer surface of said hollow roller body for fixation.

9. A heating roller with power supply, comprising:

a hollow roller body;

a heat generating member having a substrate and a patterned heat generating element on one side of said substrate;

means for bonding said heat generating member to an interior surface of said hollow roller body; and means for applying an electrical current to said heat generating member, wherein the pattern is serpentine over a central portion of said substrate and has bands along opposing edges of said substrate, the opposing edges proximate ends of said hollow roller body when said heat generating member is bonded to said hollow roller body, said serpentine pattern having three parallel serpentine regions, a first serpentine region in a center of the pattern, a second serpentine region adjacent one band and a third region adjacent the other band, and the applied electrical current produces a substantially uniform temperature across an outer surface of the hollow roller body.

10. The heating roller with power supply as claimed in claim 9, wherein comprising a pair of brushes, one brush contacting each band to provide an electrical circuit through said heat generating element.

11. The heating roller with power supply as claimed in claim 9, wherein the serpentine pattern of the first region of said heat generating member has a greater cross section than the serpentine pattern of the second and the third regions.

12. The heating roller with power supply as claimed in claim 9, wherein the serpentine pattern in the second and the third regions is denser than the serpentine pattern in the first region.

13. The heating roller with power supply as claimed in claim 9, wherein a thickness of wall of said hollow roller body is thinner at ends of said hollow roller body than in a center portion along a longitudinal axis of said hollow roller body.

14. A heating roller with power supply, comprising:

a hollow roller body;

a heat generating member having a substrate and a serpentine patterned heat generating element on one side of the substrate, the pattern including bands along opposing edges of said substrate, the opposing edges at ends of said hollow roller body when said heat generating member is mounted therein;

means for mounting said heat generating member to an interior surface of said hollow roller body; and means for applying an electrical current to said heat generating member, wherein the serpentine pattern between the bands has three serpentine regions, a first serpentine region in a center of the pattern and a second serpentine region adjacent one band and a third serpentine region adjacent the other band, wherein the heat generated by the electric current passing through the heat generating means produces a substantially uniform temperature over the outer surface of said hollow roller body.

15. The heating roller with power supply as claimed in claim 14, wherein the pattern of the first serpentine region of said heat generating member has a greater cross section than the pattern of the second and the third serpentine regions.

16. The heating roller with power supply as claimed in claim 14, wherein the pattern in the second and the third serpentine regions is denser than the pattern in the first region.

17. The heating roller with power supply as claimed in claim 14, wherein a thickness of wall of said hollow roller body is thinner at each end than in a center portion along a longitudinal axis of said hollow roller body.

* * * * *